US007413374B2

(12) United States Patent
Rogers et al.

(10) Patent No.: US 7,413,374 B2
(45) Date of Patent: Aug. 19, 2008

(54) OVERLAPPING SECURED MAT SYSTEM

(76) Inventors: D. Scott Rogers, 309 Foreman Dr., Lafayette, LA (US) 70506; Ron Houghton, 27 Oakthorn Ct., Youngsville, LA (US) 70592

( * ) Notice: Subject to any disclaimer, the term of this patent is extended or adjusted under 35 U.S.C. 154(b) by 0 days.

(21) Appl. No.: 11/444,656

(22) Filed: Jun. 1, 2006

(65) Prior Publication Data

US 2007/0280782 A1 Dec. 6, 2007

(51) Int. Cl.
*E04F 13/08* (2006.01)

(52) U.S. Cl. ..... 404/35; 404/41; 52/392; 52/570

(58) Field of Classification Search ..... 52/392, 52/569, 570, 572, 588.1; 404/34, 35, 41
See application file for complete search history.

(56) References Cited

U.S. PATENT DOCUMENTS

| | | | | |
|---|---|---|---|---|
| 4,289,420 | A | 9/1981 | Davis | |
| 4,462,712 | A | 7/1984 | Penland, Sr. | |
| 4,604,962 | A | 8/1986 | Guibault | |
| 4,629,358 | A | 12/1986 | Springston | |
| 4,875,800 | A | 10/1989 | Hicks | |
| 4,973,193 | A | 11/1990 | Watson | |
| 5,020,938 | A | 6/1991 | Scales | |
| 5,050,362 | A * | 9/1991 | Tal et al. | 52/588.1 |
| 5,797,698 | A | 8/1998 | Barth | |
| 5,816,738 | A | 10/1998 | Harnapp | |
| 5,971,655 | A | 10/1999 | Shirakawa | |
| 6,214,428 | B1 | 4/2001 | Henderson | |
| 6,455,127 | B1 | 9/2002 | Valtanen | |
| 6,511,257 | B1 | 1/2003 | Seaux | |
| 6,652,183 | B2 * | 11/2003 | Stasiewich et al. | 404/35 |
| 6,685,388 | B2 | 2/2004 | Webster | |
| 6,695,527 | B2 | 2/2004 | Seaux | |
| 6,802,159 | B1 | 10/2004 | Kotler | |
| 6,854,235 | B2 * | 2/2005 | Martensson | 52/601 |
| 6,918,221 | B2 * | 7/2005 | Williams | 52/592.1 |
| D509,604 | S | 9/2005 | Zarifian | |
| 6,942,420 | B1 | 9/2005 | Drost | |
| 7,086,205 | B2 * | 8/2006 | Pervan | 52/403.1 |
| 7,093,399 | B2 * | 8/2006 | Thiers et al. | 52/592.1 |
| 2002/0189183 | A1 * | 12/2002 | Ricciardelli | 52/390 |

* cited by examiner

*Primary Examiner*—Gary S. Hartmann
(74) *Attorney, Agent, or Firm*—Len R. Brignac

(57) ABSTRACT

A portable overlapping secured mat system with uniformly sized plastic mats joined together to form structural support surface for use by persons or equipment. The mats' edges have recessed upper and lower lips with finger projections extending from the upper lips sized to fit into holes of adjacent mats' lower lips securing the mats together when the front edge of the finger projections are moved into a recesses of the back wall of the hole.

5 Claims, 3 Drawing Sheets

OVERLAPPING SECURED MAT SYSTEM

BACKGROUND

1. Field of the Invention

The present invention relates to portable overlapping locking mats with uniformly sized plastic mats joined together to form structural support surface for use by persons or equipment. The edges of the mats have recessed upper and lower lips with finger projections extending from the upper lips that are sized to fit into openings of adjacent mats' lower lips securing the mats together. The mats can be placed into an overlapped and secured arrangement solely with machine equipment eliminating the need for manual handling of the mats.

2. Description of Related Art

Mats, utilized in a variety of embodiments, have long been used for the construction of temporary support surfaces. A few examples of patents that disclose various mat systems are as follows:

U.S. Pat. No. 6,214,428B1 (A laminated wooden support mat fitted with one or more wear mat or pad and are bolted together);

U.S. Pat. No. 4,289,420 (A wooden mat to form a roadway from interlocking mats, each mat being formed from a plurality of layers or boards, each layer being formed from boards parallel to each other and perpendicular to boards forming the adjacent layer, the layers being fastened together at points of intersection by screw shank nails or other fastening means.);

U.S. Pat. No. 4,875,800 (A temporary support structure with a plurality of panels. Each panel includes a first row of boards arranged in parallel side-by-side relationship, and a second row of boards arranged in parallel side-by-side relationship. The second row of boards is superimposed on the first row of boards and oriented perpendicularly thereto. A first plurality of panels defines a lower layer in which the second row of boards extends upwardly to define lower locking boards. A second plurality of panels defines an upper layer resting upon the lower layer wherein the second row of boards thereof extends downwardly to define upper locking boards intermeshed with the lower locking boards. Individual panels of the upper layer are intermeshed with a plurality of lower panels to create an interlocking relationship therewith.);

U.S. Pat. No. 4,973,193 (A matting system includes interlocking mats of four differing configurations. Each mat configuration consists of wooden boards fastened together to create from one to three layers of boards at various areas of the individual mats. When interlockingly installed a desired area is uniformly covered with three layers of boards. The upper, working layer of boards bears the vehicular traffic or equipment placement. The middle, intermediate layer of boards, consists of interlock boards which fittingly interlock with corresponding spaces of adjacent mats, and, interspaced boards to reinforce the weight bearing characteristics of the mats. The lower, contact layer of boards rest upon the terrain. Within a layer the boards are parallel to one another, whereas the boards of each layer are perpendicular to the boards of any adjacent layer. When installed each mat interlockingly overlaps or underlaps approximately one-third of the width and one-half of the length of laterally adjacent mats. Both lateral and longitudinal relative movement of any installed mat is substantially precluded by a portion of each mat unit being in frictional engagement with the terrain, by a portion of each mat unit overlapping interlocking with adjacent mats and all three layers of each mat laterally and longitudinally abutting other mats which are also in frictional engagement with the ground.);

U.S. Pat. No. 4,462,712 (A flooring system for use at a construction site such as an oil well drilling site. The flooring system is formed by interlocking a plurality of flooring units. Each of the flooring units includes a rectangular base section and a surface section attached to and overlaying the base section. One end of the rectangular base section is aligned with one end of the surface section which has at least one open-ended locking slot along its length. Located on the opposing end of the surface section is at least one locking tab formed from the surface section and projecting beyond and above the edge of the base section. The locking tab is aligned with the locking slot of the flooring unit).

Additionally, fastening devices are known to interconnect and secure flat shaped components such as mats. For example, U.S. Pat. No. 4,604,962 discloses an interlocking assembly for modular loading dock units, and U.S. Pat. No. 6,695,527 discloses a reusable overlapping mat system.

Any successful interlocking mat system used for support surfaces must provide substantial holding strength to prevent lateral and vertical separation of the mats. Some known mats utilize overlapping edges holding the mats by material interferences of the surfaces. The material interferences of the overlapping mats often do not fully secure the mats. Individual manual labor is typically necessary to install these mats. Other types of mats utilize separate locking devices that must be separately installed by individual after the interlocking mats are arranged in the preferred configuration.

In its preferred embodiment, the present mat does not utilize an external locking device and can be installed without individual manual handling of the mats. The mats are secured laterally and horizontally by insertion of the finger projection fitting into and underneath an adjacent mat and these mats can be installed without manual labor with just machine handling equipment. Alternatively, the mat can also utilize external locking pins or fastening devices.

SUMMARY

The present invention is an overlapping and secured mat system with uniformly sized mats that are joined together to form temporary support structures for a variety of uses, including, but not limited to, temporary building floors, walkways and other support functions. The interlocking mat is preferably made by one-piece injection molding method with rigid polymeric plastic materials. The mat's edges are recessed to form two upper lips and two lower lips to allow for the overlapping of the upper lip of one mat with the lower lip of an adjacent mat. On the bottom side of one of the upper lips, a finger projection or multiple finger projections extends beyond the horizontal and vertical plane of the mat's lips. The finger projections are sized for insertion into a hole or holes located in the lower lip of an adjacent mat. When a pair of mats overlaps, the finger projections drop into the lip holes of an adjoining mat, and the two overlapping mats are then moved together and the front edge of the finger projection is sized to fit into a recess in the back wall of the hole forming a secure joint limiting separation of the mats. Multiple mats can be joined together in this fashion to form a stable support surface.

DETAILED DESCRIPTION OF THE INVENTION

Figure 1:
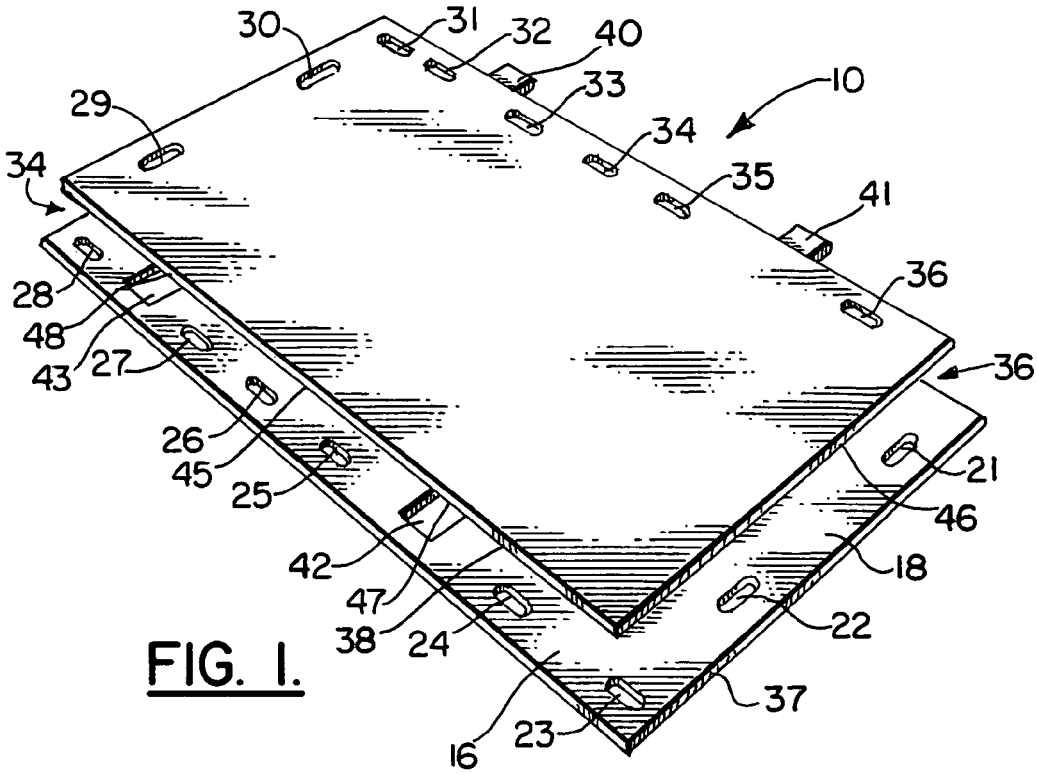
FIG. 1 is a top perspective view.

The present invention relates to an improved temporary load bearing structure made of a collection of rigid mats with overlapping recessed lips fitted together to form a continuous flat interlocking load bearing surface. In FIG. 1, each mat 10 is made of rigid material preferably rigid polymeric plastic materials, rubber or any other moldable and/or castable material. The mat 10 preferably is sized approximately 168 inches in length and 96 inches in width, approximately 4.25 inches in height and weighs approximately 900 lbs. The mat 10 is preferably made from well-known one piece injection molding manufacturing process. The interior of mat 10 can be of solid construction or separate inserts of material that can fill some or all the cells for greater load bearing strength. The insert material can be any compatible material and is preferably the same material as the mat. The inserts are sized and shaped to fit within the cells.

Figure 2:
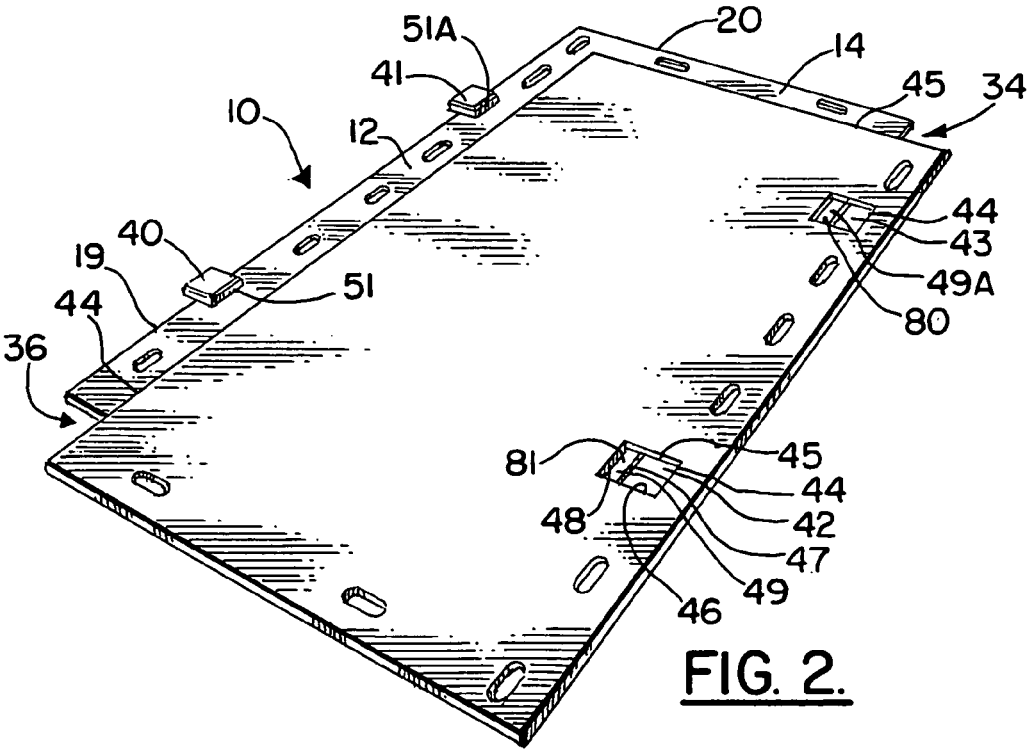
FIG. 2 is a bottom perspective view.
Figure 3:
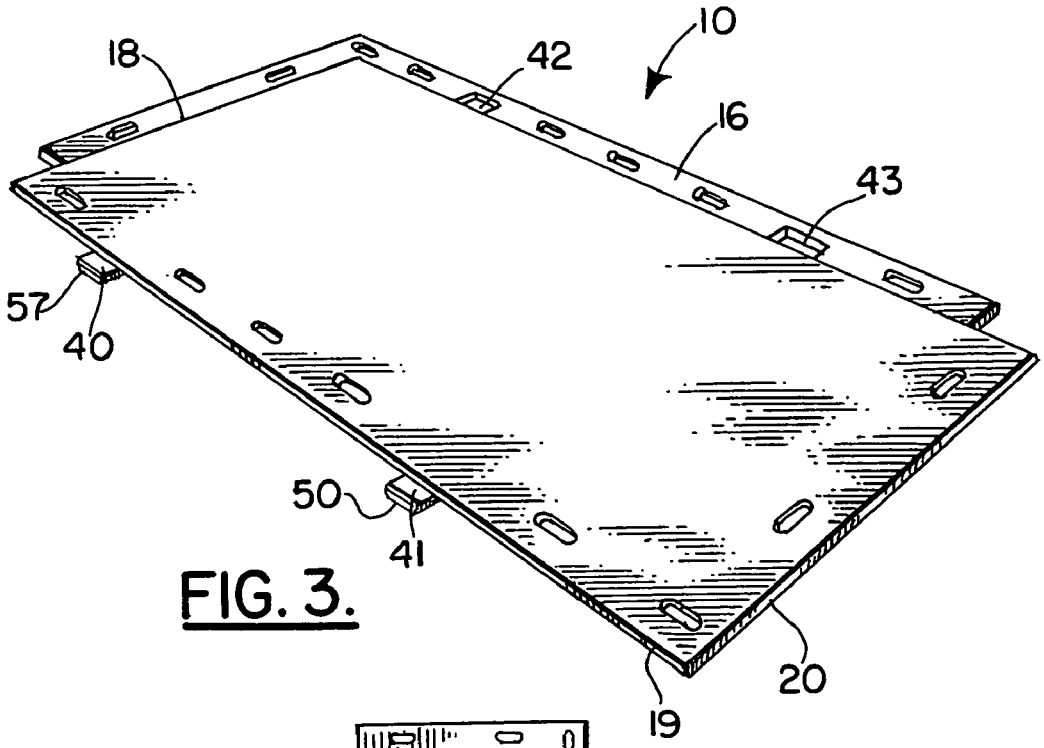
FIG. 3 is a top perspective view.

Referring to FIG. 1 and FIG. 2, two adjoining edges 19 and 20 about the perimeter of mat 10 are recessed from the bottom of the mat to form adjoining upper lips 12, 14 and upper risers 44, 45, with recessed upper lip 12 adjacent to recessed upper lip 14. The remaining two adjoining edges 37 and 38 about perimeter of mat 10 are recessed from the top to form lower lips 16, 18 and lower risers 45, 46. The risers are preferably ½ to ¾ inches in height and the edges of the mat are approximately 2 inches in height.

Mat 10 is generally square or rectangular shaped, with diagonally opposite corners 34 and 36 removed. Referring to FIG. 1, mat 10 may have uniformly spaced openings 21, 22, 23, 24, 25, 26, 27, 28, 29, 30, 31, 32, 33, 34, 35 and 36 in lips 12, 14, 16 and 18 for insertion of separate locking devices into compatible openings of an adjacent mat when the mats' lips are overlapped.

Figure 4:
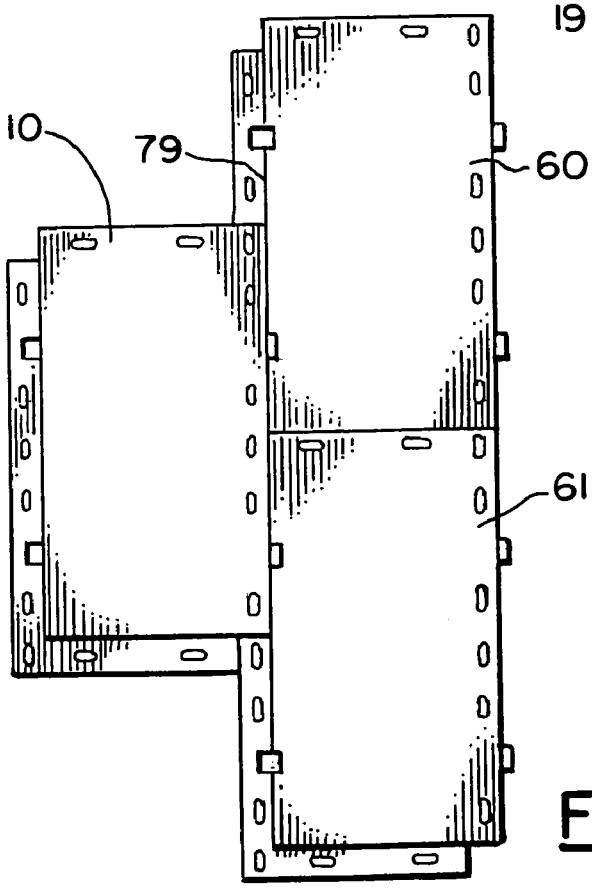
FIG. 4 is a top view of three adjacent overlapping mats.
Figure 5:
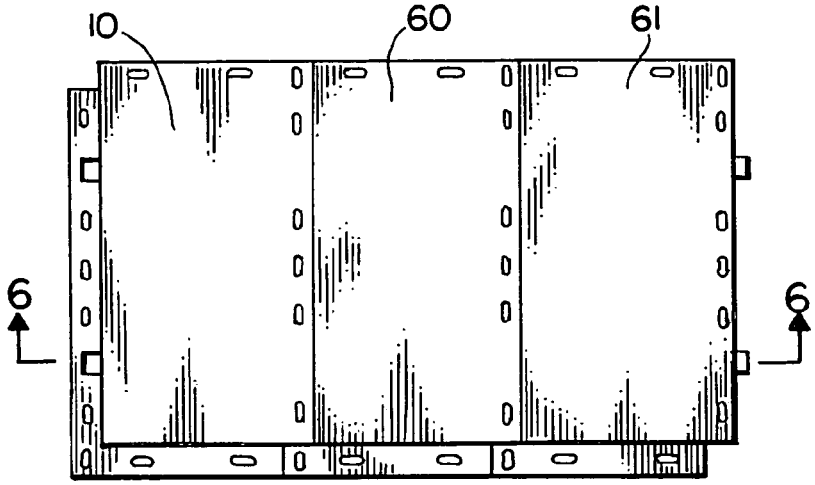
FIG. 5 is a top view of three overlapping mats.
Figure 6:
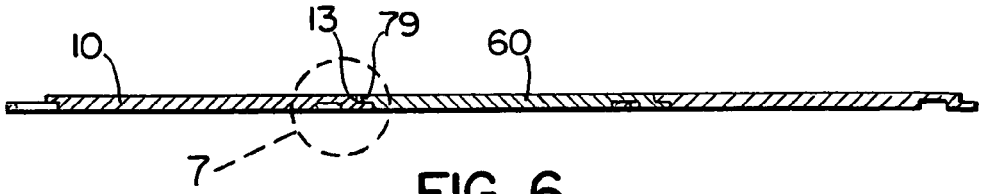
FIG. 6 is a side view of three overlapped secured mats.

Mat 10 has finger projections 40 and 41 that are located on the bottom edge of the upper lip 12, and the finger projections 40 and 41 extend outward from the horizontal plane of upper lip's 12 bottom edge and the finger projections 40 and 41 extend outward from the vertical plane of the upper lip's front edge 19. The finger projections 40 and 41 are sized to fit into holes 42 and 43 that are located on the mat's lower lip 16 that are sized to accept the finger projections 40 and 41 when the lips of adjacent mats overlap. The lower lip's holes 42 and 43 have a front wall 44 located closest to the lip's edge, two side walls 45 and 46 and an upper back wall 47 and lower back wall 48. The lower back wall 48 is sized and recessed toward the center body of the mat 10 forming a recess 80 and 81 sized to accept insertion of the front edge 50 and 57 of a mat's finger projections 40 and 41. In FIG. 4, FIG. 5 and FIG. 6, after the adjacent mats 10, 60 and 61s are overlapped and the finger projections 40 and 41 are dropped into the holes 42 and 43, the overlapping mats 10, 60 and 61 can be moved closer together in a tight fit position as the finger projections 40 and 41 move into the recesses 80 and 81 of the holes 42 and 43.

The finger projections 40 and 41 are sized and positioned on the mat's upper lip 12 to allow the finger projections 40 and 41 to move into the recess and underneath the top wall 49 and 49A of the recesses 80 and 81 with material interference between the overlapping mats limiting the mats' lateral movements. The top walls 49 and 49A of the recesses 80 and 81 limits the upper movement of the front edges 50 and 57 of the finger projection 40 and 41. The mat's finger projections 40 and 41 can have tongue and groove features or other snap fit joint for locking with a companion tongue and groove feature on the walls of the recesses 80 and 81.

Preferably, two finger projections 40 and 41 are located on each mat's upper lip 12 and two companion holes 43 and 44 are located on the opposite bottom lip 16. One of the finger projections 40 is preferably affixed at a location approximately one quarter of the length of the upper lip 12 and the second finger projection 41 is located approximately three quarters of the length location of the upper lip 12. The holes 42 and 43 are in a similar location on the lower lip 16. In the preferred mode, the finger projections 40 and 41 are eight inches in width and 8.375 inches in length, and the finger projections 40 and 41 extend approximately two inches from the vertical plane of the upper lip 12 and two inches from the horizontal plane of the upper lip 12.

In the preferred mode, the back edges of the finger projections 51 and 51*a* are approximately 6.6 inches from the upper lip's riser 44. The holes 42 and 43 in the lower lip 16 are preferably sized 8 inches in width and 7.5 inches in length. The recesses 80 and 81 are 2.25 inches in length and 8 inches in width. The front wall 44 of the holes 42 and 43 in the lower lip 16 is located 5.875 inches from the lower lips' edge 38, and the back wall 47 of the hole 47 and 48 is located at the lower lip's riser 45.

Figure 7:
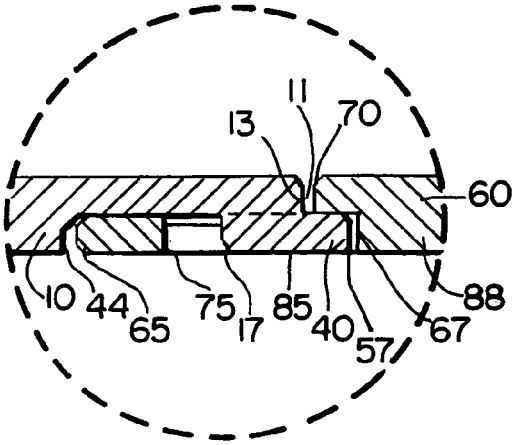
FIG. 7 is a detailed cross-section view of a finger projection secured in an adjacent mat's lip hole.

In FIGS. 4 and 5, the interlocking mat system is shown assembled when the mat 10 is placed on the lower lip 61 of an adjacent mat 60. In FIG. 7, a cross section view of mat 10 and mat 60 shows that upon insertion of the finger projections 40 of mat 10 into the hole 63 of Mat 60, the lower lip's back edge 65 of mat 60 is apart from the upper riser 44 of mat 10 the same distance that the finger projection 40 extends beyond the vertical plane of mat 10's lip edge 11. When mat 10 and mat 60 are moved closer together, the front edge 57 of finger projection 40 moves into the recess of the hole 63 toward the hole's lower back wall 67, mat 10 upper riser 44 abuts with mat 60 lower lip edge 65, mat 60 upper back wall 70 of hole 63 abuts mat 10 upper lip edge 13 and mat 10 upper lip edge 13 abuts the mat 60 lower lip riser 79 resulting in a generally flat top surface and a flat planar bottom surface of the mat system. The movement forward of the finger projection 40 into the recess of the hole 63 of mat 60 also creates a gap between the back edge of the finger projection 17 and the front wall 75 of the hole 63. The bottom side 85 of the finger projection 40 is sized to extend no farther than the bottom 88 of the adjacent mat 60 with the joined mats forming a generally flat planar bottom surface and generally flat planar top surface. Mats 10, 60 and 61 can be overlapped and secured in an offset fashion as shown in FIG. 4 or the mats 10, 60 and 61 can be assembled in a straight linear fashion as shown in FIG. 5.

Installation of the mat system is accomplished by a first mat positioned on the ground or floor by a known type of machinery such as a forklift or other material-handling device. The machine operator lifts a second mat placing the second mat adjacent to the first mat overlapping the first mat's lower lips with the second mat's upper lips and allowing the finger projections to drop in the holes in the second mat's lower lip. With the two mats overlapped in this fashion, there is a gap or separation between the first mat's lower riser and the edge of the second mat's upper lip. The machine operator moves the second mat toward the first mat, moving the front edges of the finger projections into the recesses.

The mats system can be disassembled by pulling the mats apart a sufficient distance so that the front edge of the finger projection slides out of the recess clearing the recess'upper wall. The mat and its finger projections can be lifted up out of the lower lips' holes unsecuring the mats.

Mat 60 lower lip edge 65 has a height approximately the same as mat 10 upper lip's 12 riser 44 height. The height of the back edge 17 of the finger projection 40 has a height approximately the same as the height of mat 60 hole's 63 front wall 75. The mat 10 upper lip's 12 edge has a height that is approximately the same as the height of the upper back wall of the hole 70. The mat's lips can have additional openings at spaced intervals 21-36 for alignment with openings in overlapping mats to receive a locking pin that passes through the two aligned openings of overlapping mats.

The lips sections are integrated into the body of the mat and formed during the injection molding manufacturing process and do not require further assembly. The finger projections 40 and 41 are preferably attached to the upper lips by known attachment means such as bolted, glue or hot weld techniques. The mats can be made of various sizes and the preferred embodiment exhibits the necessary strength and durability characteristics while remaining relatively lightweight.

The finger projections 40 and 41 are preferably located on the upper lip 12 with the holes 43 and 44 on the lower lip 16; however, if the mat 10 as shown in FIG. 2 is flipped over, the finger projections 40 and 41 are still designated to be on the upper lips and the holes 43 and 44 are on the lower lip 16. Top and bottom, upper and lower are used for descriptive purposes, and mat can be overlapped and secured in the reverse manner. The size and shape of the upper lips and lower lips are identical, and the designation of the lips as upper lips and lower lips are based on the preferred method of installation.

Figure 8:
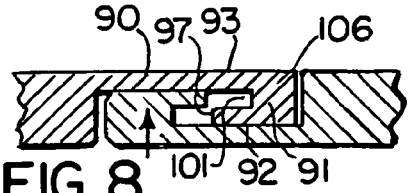
FIG. 8 is a detailed view of the hook projection.
Figure 9:
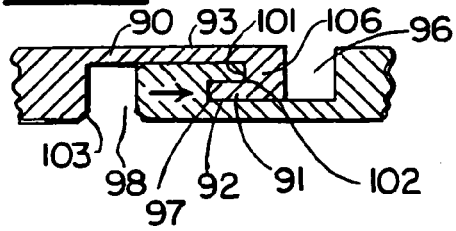
FIG. 9 is a detailed cross-section view of the hook projection secured in an adjacent mat's lip hole.

Alternatively, mat 90 can have a finger projection shaped like a hook or a backward "C". In FIGS. 8 and 9, the hook projection 91 has a bottom 92 that extends below the horizontal plane of the bottom of mat 90 upper lip 93 and the lower back edge 97 of hook projection 91 extends away from the hook projections midbody 106 and toward mat 90 central body. The mat lower lip has a hole disposed therein that is sized to allow the finger projection to fit into the hole when the pair of mats' lips overlap. Hole 96 has a lower front wall 103 that recessed toward the edge of mat forming a recess 98. After the like mats are overlapped the hook projection 91 drops into the hole of an adjacent mat, and the hook projection 91 lower back edge 97 moves into and fits into recess 98 when the mats are slightly separated. The hook projection midbody 100 has a back 101 that abuts the hole 96 upper front wall 102 when the lower back edge 97 moves into the recess 98 of the hole 96.

FIG. 7 is a side view of three overlapped secured mats.

Various changes can be made in the shape, size or arrangement of the parts of the mats and equivalent elements or materials may be substituted for those illustrated and described. Features and parts may be reversed and certain features of the invention may be utilized independently from other features, as would be apparent to one skilled in the art, after having benefit of this description.

What is claimed is:

1. An overlapping and secured mat system for temporary support structures comprising:

a plurality of uniformly sized rigid mats;

along at least one side and one end of said mats, the perimeter of said mats being recessed upward from the bottom of said mats to form an upper lip with said upper lip having a top side and a bottom side;

at least one opposite side and opposite end of said mats are recessed downward from top of said mats to form a lower lip with said lower lip having a top side and bottom side;

the distance to which said mat edges are recessed to form said lips being substantially the same thus allowing for the overlapping of said upper lips and lower lips about the edges of said mat with respective like lower lips and upper lips of other like mats when placed adjacent thereto for joining therewith by which said overlapping mats form a generally flat continuous top and bottom surface;

at least one finger projection located on the bottom side of the upper lip with said finger projection having a front edge, a back edge, and a bottom side with said front edge of the finger projection extending out from upper lip's vertical plane and the bottom side of said finger projection extending from the bottom side the upper lip's horizontal plane;

the lower lip of said mat has at least one hole disposed therein;

said hole is sized to allow insertion of said at least one finger projection when said upper lip of said mat overlaps lower lip of other like mats;

said hole has a front wall located nearest to the lower lip's edge, two side walls and an upper back wall and lower back wall;

said lower back wall of the hole is recessed toward the central body of mat forming a recess having a top wall;

said recess is sized to allow insertion of the front edge of the finger projection securing by material interference the front edge of the finger projection within the recess of the hole.

2. The mat system of claim 1 wherein:

said finger projection has a composite integral fit joint, a snap fit joint or an integral design feature joint that forms a joint with a composite integral fit joint, snap fit joint or an integral design feature joint in the walls of the hole or the recess.

3. The mat system of claim 1 wherein:

said upper lips and said lower lips have at least one uniformly spaced opening which can be aligned with said opening in said lip of overlapping adjacent mat;

wherein said openings are sized and aligned to allow a fastening device to fit into said aligned overlapped openings and to secure mats together;

said a fastening device can be a pin, a stake, a bolt, clamp, a screw, a clip, a peg or external fastening device.

4. The interlocking mat of claim 1 wherein:

said recessed upper lips form upper risers and said recessed lower lips form lower risers;

the edge of the lower lip of said mat has a height approximately the same as height of the upper lip's riser;

the edge of the upper lip of said mat has a height that is approximately the same as the height of the upper back wall of the hole;

the height of the back edge of the finger projection is approximately the same height as the height of the hole's front wall.

5. An overlapping and secured mat system for temporary support structures comprising:

a plurality of uniformly sized rigid mats;

along at least one side and one end of said mats, the perimeter of said mats being recessed upward from the bottom of said mats to form an upper lip with said upper lip having a top side and a bottom side;

at least one opposite side and opposite end of said mats is recessed downward from top of said mats to form a lower lip with said lower lip having a top side and bottom side;

the distance to which said mat edges are recessed to form said lips being substantially the same thus allowing for the overlapping of said upper lips and lower lips about the edges of said mat with respective like lower lips and upper lips of other like mats when placed adjacent thereto for joining therewith by which said overlapping mats form a generally flat continuous top and bottom surface;

at least one finger projection located on the bottom side of the upper lip with said finger projection having a front edge, a back edge, and a bottom side with said front edge of the finger projection extending out from upper lip's vertical plane and the bottom side of said finger projection extending from the bottom side of the upper lip's horizontal plane;

the mat's lower lip has at least one hole disposed therein;

said hole is sized to allow insertion of said at least one finger projection when said upper lip of first mat overlaps lower lip of other like mat;

said hole has a front wall located nearest to the lower lip's edge, two side walls and an upper back wall and lower back wall;

said lower back wall of the hole is recessed toward the central body of mat forming a recess with a top wall of said recess;

said recess is sized to allow insertion of the front edge of the finger projection securing by material interference the front edge of the finger projection within the recess of the hole;

said recessed upper lips form upper risers and said recessed lower lips form lower risers; the mat's lower lip edge has a height approximately the same as the upper lip's riser height;

the height of the back edge of the finger projection is approximately the same as the height of the hole's front wall;

wherein, the mat system in its overlapped and secured state, one of the uniformly sized rigid mat is adjacent to a second uniformly sized rigid mat with the front edge of the finger projection of first mat is fitted into the recess of the hole of second mat with the first mat's upper riser abutting with the second mat's lower lip edge and the edge of the said second mat abuts first mat's lower riser resulting in a generally flat planar top surface and a flat planar bottom surface.

* * * * *